United States Patent [19]

Contois et al.

[11] 4,152,152

[45] May 1, 1979

[54] ADDITIVES FOR CONTRAST CONTROL IN ORGANIC PHOTOCONDUCTOR COMPOSITIONS AND ELEMENTS

[75] Inventors: Lawrence E. Contois, Webster; Jean E. Jones, Rochester, both of N.Y.

[73] Assignee: Eastman Kodak Company, Rochester, N.Y.

[21] Appl. No.: 766,830

[22] Filed: Feb. 8, 1977

Related U.S. Application Data

[63] Continuation-in-part of Ser. No. 543,401, Jan. 23, 1975, abandoned, which is a continuation-in-part of Ser. No. 403,574, Oct. 4, 1973, abandoned.

[51] Int. Cl.[2] ..... G03G 5/06; G03G 5/09

[52] U.S. Cl. ..... 96/1.6; 96/1.5 R

[58] Field of Search ..... 96/1.6, 1.5; 252/501

[56] References Cited

U.S. PATENT DOCUMENTS

| | | | |
|---|---|---|---|
| 3,037,861 | 6/1962 | Hoegl et al. | 96/1.5 C |
| 3,287,123 | 11/1966 | Hoegl | 96/1.5 |
| 3,745,160 | 7/1973 | Daniel et al. | 96/1.6 |
| 3,769,011 | 10/1973 | Gilman et al. | 96/1.6 |
| 3,814,600 | 6/1974 | Contois | 96/1.6 |
| 3,958,991 | 5/1976 | Jones et al. | 96/1.6 |
| 3,966,468 | 6/1976 | Contois et al. | 96/1.5 |

FOREIGN PATENT DOCUMENTS

| | | | |
|---|---|---|---|
| 48-25659 | 7/1973 | Japan | 96/1.5 C |

OTHER PUBLICATIONS

Bube, *Photoconductivity of Solids,* 1960, pp. 41–42 and 160–161.

Gould, *Inorganic Reactions and Structure,* 1965, pp. 90–95.

Cotton et al., *Advanced Inorganic Chemistry,* 1967, pp. 571–572.

Hoegl, "On Photoelectric Effects in Polymers and Their Sensitization by Dopants", *Journal of Physical Chemistry,* vol. 69, No. 3, Mar. 1965, pp. 755–766.

Hayashi et al., "Sensitization in the Photoconductance of Poly-N-Vinylcarbazole", *Bulletin of the Chemical Society of Japan,* vol. 39, No. 8, 1966, pp. 1660–1670.

Terenin, "Charge Transfer in Organic Solids, Induced by Light", *Proceedings of the Chemical Society,* Sep. 1961, pp. 321–329.

Juster, "Organic Semiconductors", *Journal of Chemical Education,* vol. 40, No. 10, Oct. 1963, pp. 547–555.

Kallmann et al., *Symposium on Electrical Conductivity in Organic Solids,* 1961, pp. 347–352.

Kearns, "Electrical Properties of Organic Solids . . . ", *University of California, Lawrence Radiation Laboratory (Thesis),* Mar. 25, 1960, pp. 101–102 and 117–118.

Meier, "Sensitization of Electrical Effects in Solids", *Journal of Physical Chemistry,* vol. 69, No. 3, Mar. 1965, pp. 719–729.

Masuda et al., *Energy and Charge Transfer in Organic Semiconductors,* 1974, (papers presented at seminar held at Osaka, Japan, Aug. 6–9, 1973), pp. 109–125.

Meier, "Experiments on the Electronic Mechanism of the Photoconductivity of Sensitizing Dyes", *Photographic Science and Engineering,* vol. 6, No. 4, Jul.–Aug. 1962, pp. 235–240.

"Supersensitizing Dye Combinations for Electrophotographic Composition and Element", *Research Disclosure,* Oct. 1972, No. 10217, pp. 14–15.

*Primary Examiner*—Roland E. Martin, Jr.
*Attorney, Agent, or Firm*—Ronald P. Hilst

[57] ABSTRACT

Electrostatic contrast control in p-type electrophotographic elements is achieved by incorporating into the photoconductive layer a hole trapping agent such as a tetraphenylboron anion, bromide ion, iodide ion, oxidizable dye such as a carbocyanine and dicarbocyanine, merocarbocyanine and merodicarbocyanine, styryl, oxonol, hemioxonol, or hemicyanine. Usable hole trapping agents have an oxidation potential in a neutral solution of at least 0.1 volts less than that of the photoconductor in the photoconductive layer.

22 Claims, No Drawings

ADDITIVES FOR CONTRAST CONTROL IN ORGANIC PHOTOCONDUCTOR COMPOSITIONS AND ELEMENTS

This is a continuation-in-part of U.S. Patent Application Ser. No. 543,401, filed Jan. 23, 1975 now abandoned which is a continuation-in-part of U.S. Patent Application Ser. No. 403,574, filed Oct. 4, 1973, now abandoned.

BACKGROUND OF THE INVENTION

This invention relates to electrophotography, and more particularly to novel photoconductive compositions which provide a reduced image contrast.

The process of xerography, as disclosed by Carlson, for example, in U.S. Pat. No. 2,297,691, employs an electrophotographic or photoconductive element comprising a coating of a photoconductive insulating material on a conductive support. The photoconductive element is given a uniform surface charge in the dark and is then exposed to an image pattern of activating electromagnetic radiation such as light or x-rays. The charge on the photoconductive element is dissipated in the illuminated area to form an electrostatic charge pattern which is then developed by contact with electroscopic marking material. The marking material or toner, as it is also called, whether carried in an insulating liquid or in the form of a dry powder, deposits on the exposed surface with either the charge pattern or the discharge pattern, as desired. Then, if the photoconductive element is of the non-reusable type, the developed image is fixed by fusion or otherwise to the surface of the photoconductive element. If the element is of the reusable type, e.g., a selenium-coated drum, the image is transferred to another surface such as paper and then fixed to provide a copy of the original.

A problem that has existed is the control of electrostatic contrast in the electrophotographic materials. Electrostatic contrast can be defined quantitatively in terms of gamma ($\gamma$), which is derived from the electrical H and D curve. This curve is analogous to the type of curve first employed by Hurter and Driffield for silver halide sensitometry, except that voltage or charge on the electrophotographic element is used instead of silver density. In the straight portion of the electrical H and D curve, where the change in voltage (which corresponds to the change in image density) is proportional to the change in the logarithm of the exposure, the slope is called gamma ($\gamma$) and provides a quantitative measure of the electrographic contrast.

It is recognized in the art that p-type organic photoconductive materials (that is, these organic photoconductors whose primary mode of photoconduction is provided by positive charge carriers, i.e., holes), can be sensitized or activated by dyestuffs or other materials which serve as electron-trapping agents. For example, U.S. Pat. No. 3,287,123 of Hoegl at column 2, lines 20–42 describes several broad classes of organic photoconductors (or "electron donors" in the nomenclature of the Hoegl patent) and further discloses that such p-type photoconductors can be sensitized by "activator" substances which act as electron-acceptors. An electron-acceptor is a material which (as is apparent from the term "electron-acceptor") is an electron-trapping agent. Similarly, U.S. Pat. No. 3,745,160 of Daniel et al. discloses a novel class of spectral sensitizing dyes particularly useful for p-type organic photoconductors. The class of sensitizing dyes disclosed in Daniel et al are cyanine dyes containing a 1,3,2-dioxazaborinium salt or a 1,3,2-diazaborinium salt. In general, the dioxazaborinium and diazaborinium sensitizing dye salts disclosed therein are materials which desensitize negative silver bromoiodide emulsions, and therefore these materials also are electron-trapping agents (column 2, lines 41–53). This is because materials which desensitize negative silver bromoiodide emulsions generally do so by trapping electrons generated by the light sensitive silver bromoiodide grains thereof. Likewise, the various sensitizing materials for p-type organic photoconductors described in U.S. Pat. No. 3,814,600 of Contois at Tables I and II, column 6, lines 15–18, and column 7, lines 5–29, provide sensitization of p-type organic photoconductive materials by acting as electron-trapping agents. This is specifically noted for certain of the dye salt sensitizers disclosed in the Contois patent, for example, see column 5, lines 29–42 thereof. Similarly, U.S. Pat. No. 3,769,011 of Gilman et al. describes a variety of J-aggregated methine dye salts which can be used to sensitize p-type organic photoconductors (See column 8, lines 17–52). In the case of Gilman et al. the J-aggregated methine dyes serve as electron-trapping agents and thereby provide sensitization of the p-type organic photoconductive compositions.

Much of the research and development work which has been carried out with respect to the sensitization of p-type organic photoconductive compositions has been directed, as indicated in the above-noted patents, to the discovery of new and improved sensitizing addenda for these photoconductors, for example, sensitizing dyes such as dye cations of dye salts. For this reason, until the present invention, it was not appreciated in the electrophotographic art that, if a particular sensitizing dye consisted of a dye salt, the anion of the dye salt could also have an important effect on the resultant properties of the organic photoconductive composition.

Typically, p-type organic photoconductive materials such as those described in the above-noted prior art patents, i.e., those compositions which incorporate various electron trapping agents as sensitizers, tend to exhibit relatively high contrast. In some applications of electrophotographic materials, this increase in contrast is unimportant. In other applications, however, it is desired that contrast be decreased or minimized. Many compounds known to control contrast, however, result in decreased sensitization. Therefore, there is a need in the art for a method of controlling contrast in electrophotographic materials without substantial reduction in electrical speed or other desired qualities.

Further, it is also desired that contrast controlling compounds be soluble, i.e. non-crystalline, in solid solutions of photoconductive materials.

It is an object of this invention to provide photoconductive compositions capable of producing electrophotographic reproductions of reduced contrast, preferably having a relative average contrast at least 10% lower than the same composition without the contrast controlling material.

It is a further object of this invention to provide an electrophotographic element which has a particular desired contrast. For example, it may be desired initially to employ an element which has a relatively high contrast and then to make copies of the high contrast image with a photoconductive element of lower contrast.

It is a further object of this invention to develop methods for producing electrophotographic elements from said photoconductive compositions.

SUMMARY OF THE INVENTION

In accordance with the present invention, it has been found that certain anions and compounds can desensitize, i.e., reduce the light sensitivity, of p-type organic photoconductive compositions. This is because these materials act as hole-trapping agents, rather than electron-trapping agents. That is, these materials act as sites for trapping the positive charge carriers (i.e., the holes) which are generated by a p-type organic photoconductor. However, it has also been found that by using a suitable amount of a hole-trapping agent in a p-type organic photoconductive composition, one can minimize the decrease in light sensitivity caused by the addition of such a hole-trapping agent and at the same time this agent will advantageously lower the relatively high contrast exhibited by many conventional p-type organic photoconductive compositions. Thus, as explained hereinabove, it was found that one could provide an effective means for controlling the contrast of a relatively high contrast p-type organic photocnductive composition by the use of a hole-trapping agent, and this could be achieved without suffering a loss of other desirable qualities such as light sensitivity. For a more detailed explanation of the phenomena of hole trapping, see Bube, *Photoconductivity of Solids,* Wiley (1960), particularly chapters 2, 3, 7 and 9.

A given hole trapping agent is suitable for use in the present invention if its oxidation potential in a neutral solution is at least 0.1 volts less than that of the organic photoconductor it is to be used in conjunction with. As used herein and in the appended claims, oxidation potential determinations are made in accordance with the following procedure. The anodic (oxidation) voltametric potentials of the hole-trapping agents and photoconductors are determined against an aqueous silver - silver chloride reference electrode for the electrochemical oxidation of the material being tested at a pyrolytic graphite electrode using controlled-potential voltammetric techniques. A $1\times10^{-4}$ M acetonitrile solution of the test material is prepared. There is present in the test solution, as supporting electrolyte, a 0.1 M solution of lithium chloride. The reference electrode is maintained at 20 C. Signs are given according to the recommendation of IUPAC at the Stockholm Convention, 1953. The theory of potential sweep voltammetry such as that employed in obtaining the anodic determinations is described by Delahay, "New Instrumental Methods in Electrochemistry" Interscience Publishers, New York (1954) and Nicholson and Shain, *Anal. Chem.,* 36, 706 (1964). Information concerning the utility and characteristics of the pyrolytic graphite electrode is described by Chuang, Fried and Elving, *Anal. Chem.,* 36 (1964). Suitable hole trapping agents include tetraarylboron anions, such as tetraphenylboron anions; bromide ions; iodide ions; and easily oxidized dyes such as carbocyanines, dicarbo cyanines, mercocarbocyanines, merodicarbocyanines, styryls, oxonols, hemioxonols, and hemicyanines, which dyes are commonly used as spectral sensitizers for negative silver halide emulsions. Other suitable hole trapping agents are compounds which act as halogen acceptors in silver halide emulsion system, such as aryl pyrazolidones and ketone semicarbazones. Preferred hole trapping agents include tetraarylboron anions and bromide and iodide ions.

Electrophotographic elements of the invention can be prepared by making coating solutions (dopes) comprised of a film-forming binder, a p-type organic photoconductor, a spectral sensitizing dye for the photoconductor, a small effective amount of a hole trapping agent whose oxidation potential in a neutral acetonitrile solution is at least 0.1 volts less than that of said organic photoconductor, and preferably at least 0.12 volts less, and a suitable volatile solvent and coating a layer of such a solution uniformly over an electrically conducting support material. The hole-trapping agent is present in an amount sufficient to reduce the relative average contrast to at least 10% lower than the relative average contrast in the absence of the hole trapping agent. This amount will usually constitute between 0.01% and 2.0% by weight of the total solids in the final composition.

To achieve advantageous contrast control of p-type organic photoconductive compositions by the incorporation therein of hole-trapping agents, such as bromide, iodide, or other similar hole-trapping agents, it is highly preferred to be able to vary the amount of the hole-trapping agent within the p-type organic photoconductive composition without affecting the amount of sensitizing addenda which may also be incorporated therein. This is because the amount of hole-trapping agent used to achieve effective contrast control is generally much less than the amount of sensitizing dye material incorporated into conventional p-type organic pohtoconductive compositions to achieve effective sensitization thereof. Moreover, it has been further found that if one did incorporate (in a p-type organic photoconductive composition) typical hole-trapping agents in an amount equivalent to that of the sensitizing dye, one generally obtained a resultant p-type organic photoconductive composition containing such a large amount of hole-trapping agent that large losses in light sensitivity were produced. For this reason, it is clearly preferable (when using a dye salt as a sensitizer for a p-type photoconducitve composition) to select a dye salt having an appropriate sensitizing or electron-trapping dye cation and having as the anion thereof a relatively neutral or inert species with respect to electron-trapping or hole-trapping capability, such as a sulfo-, fluoroborate-, fluorophosphate-, or chloro-containing anion.

Coating thicknesses of the photoconductive composition on a support can vary widely. Normally, a coating in the range of about 1 micrometer to about 500 micrometers after drying is useful for the practice of this invention. The preferred range of coating thickness is found to be in the range from about 5 micrometers to about 200 micrometers after drying, although useful results can be obtained outside of this range.

Suitable supporting materials for the photoconductive layers of the present invention can include any of a wide variety of electrically conducting supports, for example, various conducting papers; aluminum coated paper; aluminum-paper laminates; metal foils such as aluminum foil, zinc foil, etc.; metal plates, such as aluminum, copper, zinc, brass, and galvanized plates; vapor deposited metal layers such as silver, nickel or aluminum on conventional film supports such as cellulose acetate, poly(ethylene terephthalate), polystyrene and the like conducting supports. An especially useful conducting support can be prepared by coating a support material such as poly(ethylene terephthalate) with a layer containing a semiconductor dispersed in a resin as described in U.S. Pat. No. 3,245,833 or vacuum deposited on the support. Likewise, a suitable conducting coating can be prepared from the sodium salt of a carboxyester lactone of a maleic anhydridevinyl acetate copolymer. Such kinds of conducting layers and methods for their optimum preparation and use are disclosed in U.S. Pat. Nos. 3,007,901; 3,245,833 and 3,267,807.

Some organic p-type photoconductors useful in the present invention include:

arylamine photoconductors including substituted and unsubstituted arylamines, diarylamines, nonpolymeric triarylamines and polymeric triarylamines such as those described in Fox U.S. Pat. No. 3,240,597 and Kulpfel et al. U.S. Pat. No. 3,180,730;

polyarylalkane photoconductors of the types described in Noe et al. U.S. Pat. No. 3,274,000, Wilson U.S. Pat. No. 3,542,547, Seus et al. U.S. Pat. No. 3,542,544, Rule U.S. Pat. No. 3,615,402, and Fox U.S. Pat. No. 3,265,496;

4-diarylamino-substituted chalcones of the types described in Fox U.S. Pat. No. 3,526,501;

non-ionic cycloheptenyl compounds of the types described in Looker U.S. Pat. No. 3,533,786;

compounds containing an >N—N< nucleus, as described in Fox U.S. Pat. No. 3,542,546;

organic compounds having a 3,3'-bis-aryl-2-pyrazoline nucleus, as described in Fox et al. U.S. Pat. No. 3,527,602;

triarylamines in which at least one of the aryl radicals is substituted by either a vinyl radical or a vinylene radical having at least one active hydrogen-containing group, as described in Brantly et al. U.S. Pat. No. 3,567,450;

triarylamines in which at least one of the aryl radicals is substituted by an active hydrogen-containing group, as described in Brantly et al. Belgian Pat. No. 728,563;

organo-metallic compounds having at least one amino-aryl substituent attached to a Group IVa or Group Va metal atom, as described in Goldman et al. Canadian Pat. No. 818,539; and other p-type organic photoconductors such as azourethanes; heterocyclic compounds such as carbazoles, oxazoles, benzothiazoles, imidazoles, tetrazacyclooctotetraenes, etc; aromatic hydrocarbons such as acenaphthene, anthracene, phenanthrene, etc, as well as polymers containing the same; ketonic compounds such as benzil, benzophenone, etc; polymeric materials such as polyvinylcarbazole, polymers of formaldehyde and aromatic hydrocarbons, etc, as well as mixtures of such materials with Lewis acids; pigments such as phthalocyanine; dyes such as Rhodamine B, crystal violet, etc; and many others.

In addition, charge transfer combinations, e.g., those comprising a photoconductor and a Lewis acid, as well as photoconductive compositions involving complexes of non-photoconductive material and a Lewis acid, such as described, for example, in Jones U.S. Defensive Publication T881,002 and Mammino U.S. Pat. Nos. 3,408,181 through 3,408,190, and Inami et al. U.S. Pat. No. 3,418,116 may also be useful.

Among p-type inorganic photoconductors are selenium, sulfor, lead sulfide and other inorganic photoconductors including the p-type materials listed in Middleton et al. U.S. Pat. No. 3,121,006.

Electrophotographic elements used in the method of the invention can be prepared with organic or inorganic photoconducting compounds in the usual manner, i.e. by blending a dispersion or solution of a photoconductive compound together with a binder, when necessary or desirable, and coating or forming a self-supporting layer with the photoconductor-containing material. Mixtures of photoconductors can be employed. Examples of suitable photoconductors include those described in Light, U.S. Pat. Nos. 3,615,414 and 3,615,418. In addition, supplemental materials useful for changing the spectral sensitivity or electrophotosensitivity of the element can be added to the composition of the element.

Sensitizing compounds can be selected from a wide variety of materials, including such materials as disclosed in Van Allen et al. U.S. Pat. No. 3,250,615, and the like; aggregate-type sensitizers of the type described in U.S. Pat. Nos. 3,615,414 and 3,615,418; aromatic nitro compounds of the kind described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 2,732,301; mineral acids; carboxylic acids, such as maleic acid, di- and tri-chloroacetic acids, and salicyclic acid; sulfonic and phosphoric acids and others known in the art. Preferred sensitizers include those having anions comprising moieties selected from the group consisting of sulfo, fluorophosphate, tetrafluoroborate and chloro groups. As mentioned hereinabove, these sensitizers have anions which are relatively neutral or inert with respect to electron-trapping or hole-trapping capability. Specific examples of sensitizers are listed below in connection with the examples.

Preferred binders for use in preparing the photoconductive layers are film-forming, hydrophobic polymeric binders having fairly high dielectric strength which are good electrically insulating film-forming vehicles. Materials of this type comprise styrene-butadiene copolymers; silicone resins; styrene-alkyd resins; silicone-alkyd resins; soya-alkyd resins; poly(vinyl chloride); poly(vinylidene chloride); vinylidene chlorideacrylonitrile copolymers; poly(vinyl acetate); vinyl acetatevinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly[ethylene-co-alkylenebis(alkyleneoxyaryl) phenylenedicarboxylate]; phenolformaldehyde resins; ketone resins; polyamides; polycarbonates; polythiocarbonates; poly[ethylene-co-isopropylidene-2,2-bis(ethyleneoxyphenylene) terephthalate]; copolymers of vinyl haloacrylates and vinyl acetate such as poly(vinyl-m-bromobenzoate-co-vinyl acetate); etc. Suitable resins of the type contemplated for use in the photoconductive layers are sold under such tradenames as Vitel PE-101, Cymac, Piccopale 100, Saran F-220, and Lexan 145. Other types of binders which can be used in the photoconductive layers include such materials as paraffin, mineral waxes, etc.

The electrophotographic elements of the invention are used for making xerographic images in the following manner: The electrophotographic element is held in the dark and given a blanket electrostatic charge by placing it under a corona discharge. This uniform charge is retained by the photoconductive layer because of the substantial dark insulating property of the layer, i.e., the lower conductivity of the layer in the dark. The electrostatic charge formed on the surface of the photoconductive layer is then selectively dissipated from the surface of the layer by image-wise exposure to light by means of a conventional exposure operation such as, for example, by a contact-printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush toner applicator are described in the following U.S. Pat. Nos. 2,786,439; 2,786,440; 2,786,441; 2,811,465; 2,874,063; 2,984,163; 3,040,704; 3,117,884; and Reissue No. 25,779. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 and in Australian Pat. No. 212,315. In dry developing processes, the most widely used method of obtaining a permanent record is achieved by selecting a developing particle which has as one of its components a low-melting resin. Resting the powder image then causes the resin to melt or fuse into or onto the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in a number of U.S. and foreign patents, such as U.S. Pat. Nos. 2,297,691 and 2,551,582 and in "RCA Review" Vol. 15 (1954) pages 469–484.

Further understanding of the invention can be gained from the examples stated hereinafter. The examples describe the preparation and testing of a series of photoconductive elements comprising a photoconductive layer coated on various supports.

The examples, utilize the hole-trapping agents and sensitizing dyes as designated below:

Hole Trapping Agents

A Tetrapropylammonium Iodide
B Tetrapropylammonium Bromide
C Sodium Tetraphenylboron
D Tetrabutylammonium Iodide
E Tetrabutylammonium Bromide
F 1-Phenyl-3-pyrazolidone
G Acetone Semicarbazone
H Bis(s-triazine-2-ylamino)stilbene-2,2'-disulfonic acid, sodium salt
I 5-[(3-Ethylbenzothiazolin-2-ylidene)ethylidene]-3-ethylrhodanine
J 3,3'-Diethyl-9-methylthiacarbocyanine p-toluenesulfonate
K 5-[3)-Ethylbenzoxazoline-2-ylidene)ethylidene]-3-ethylrhodanine
L 5,5',6,6'-Tetrachloro-1,1',3,3'-tetraethylbenzimidazolocarbocyanine chloride
M 3,3'-Diethylthiacarbocyanine paratoluenesulfonate
N 5,5'-Dichloro-3,3',9-triethylthiacarbocyanine bromide
O 3,3'-Diethylthiadicarbocyanine iodide
P 1,1'-Diethyl-2,2'-carbocyanine iodide
Q 5-(3-Nitrobenzylidene)rhodanine
R 3-Carboxymethyl-5-[(3-methyl-2-thiazolidinylidene)-1-methyl ethylidine]rhodanine
S 1-Carboxymethyl-5-[(3-ethylbenzoxazolin-2-ylidene)ethylidene]-3-phenyl-2-thiohydantoin
T 3-Ethyl-5-[(3-ethylbenzothiazolin-2-ylidene)-1-methylethylidene]-2-thio-2,4-oxazolidinedione
U 3-Carboxymethyl-5-[(3-ethylbenzoxazolin-2-ylidene)-ethylidene]rhodanine
V 2-Diphenylamino-(3-ethyl(3H)benzothiazolylidene ethylidene)-4(5)thiazolone
W 9-Ethyl-3,3'-dimethyl-4,5:4',5'-dibenzothiacarbocyanine chloride
X 2-(4-Diethylaminostyryl)benzothiazole
Y Bis[1,3-bis(5-carboxypentyl)barbituric acid (5)]-trimethine oxonol Agents A–E are preferred.

Sensitizing Dyes

I 6-Chloro-1'-methyl-1,2',3-triphenylimidazo[4,5-b]quinoxaline-3-indolocarbocyanine-p-toluenesulfonate
II 2,4,6-Triphenylpyrylium tetrafluoroborate
III 2,6-Bis(4-ethylphenyl)-4-(4-n-amyloxyphenyl)-thiapyrylium perchlorate
IV 2-[(3,5-Dimethyl-1-phenyl-4-pyrazolyl)vinyl]-1,3,3-trimethyl-3H-pyrrolo[2,3-b]pyridinium salt
V 2,6-Diphenyl-4-(4-dimethylaminophenyl)-thiapyrylium fluoroborate
VI 2-[2-(1-Methyl-2-phenyl-3-indolyl)vinyl]-6-chloro-1,3-di-phenylimidazo[4,5-b]quinoxalinium p-toluenesulfonate
VII 4-(4-n-Amyloxyphenyl)-2,6-bis(4-ethylphenyl)-thiapyrylium perchloriate Examples using the above agents and sensitizing dyes for controlling contrast are given below. The examples include three amine photoconductors and two different binders. All coatings were made at 160 micrometers wet thickness except Examples VI and VII, where the wet thickness was 100 micrometers, on conducting supports held to a coating plate maintained at about 30° C. The samples were then coated on the edges with a conducting paste, charged to about 600 V by a corona charger, and exposed to either a xenon or a tungsten source (3000° K.) modulated by a continuous wedge. The surface potential is read as a function of exposure and the speeds at $V_o$–100 V (shoulder) and at 100 V (toe) are determined.

The relative average contrast is calculated by the formula $$(V_{shoulder} - V_{toe}) \times 10^{-2} / (\log \text{shoulder speed} - \log \text{toe speed}),$$

where $V_{shoulder}$ is the voltage at which the shoulder speed is determined, and $V_{toe}$ is the voltage at which toe speed is determined. For example, $V_{shoulder} = V_o - 100V$, and $V_{toe} = 100V$. The contrast ($\gamma$) is determined as the slope of a straight line drawn through the part of the curve in which the rate of decrease in voltage with exposure is essentially constant.

EXAMPLE I

The following solutions are coated over an evaporated nickel layer (0.4 density) on a poly(ethylene terephthalate) support.

| | |
|---|---|
| Lexan 145* | 1.6 g |
| Phenyldibenzylamine | 0.4 g |
| Dye III | 10 mg |
| Agent A (concentration in grams as specified in Table I) | |
| Methylene chloride | 11.7 ml |

*A polycarbonate resin sold by General Electric Company.

The following table shows the reduction in contrast by the iodide salt.

Table I

| Agent (g) | Effects on Contrast: Relative Speed (+) Shoulder | Relative Speed (+) Toe | Relative Average Contrast | Relative Speed (−) Shoulder | Relative Speed (−) Toe | Relative Average Contrast |
|---|---|---|---|---|---|---|
| None | 1000 | 100 | 4.0 | 1070 | 4.5 | 2.9 |
| A(0.0002) | 450 | 8.6 | 2.3 | 570 | 11.4 | 2.4 |
| A(0.0005) | 340 | 6.4 | 2.3 | 260 | 6.4 | 2.5 |

EXAMPLE II

Coatings are made like those of Example I except that the iodide salt is replaced by tetrapropylammonium bromide (Agent B). The data in the following table shows the lower contrast resulting from the addition of this salt.

Table II

| Agent (g) | Effects on Contrast: Relative Speed (+) Shoulder | Relative Speed (+) Toe | Relative Average Contrast | Relative Speed (−) Shoulder | Relative Speed (−) Toe | Relative Average Contrast |
|---|---|---|---|---|---|---|
| None | 1000 | 100 | 4.0 | 1070 | 4.5 | 2.9 |
| B(0.0005) | 1140 | 36 | 2.6 | 1300 | 36 | 2.6 |
| B(0.001) | 860 | 21 | 2.5 | 710 | 21 | 2.5 |
| B(0.002) | 710 | 8.5 | 2.2 | 570 | 11.4 | 2.4 |
| B(0.004) | 2320 | 2.3 | 2.0 | 180 | 2.9 | 2.3 |

EXAMPLE III

The following solutions are coated at 160 micrometers wet thickness on a transparent support containing a conducting layer prepared from the sodium salt of a carboxyester lactone of a maleic anhydride vinyl acetate copolymer disclosed in U.S. Pat. No. 3,007,901.

| | |
|---|---|
| Vitel PE 101* | 1.5 g |
| Triphenylamine 0.5 | g |
| Dye (as listed in Table III) | |
| Agent (as listed in Table III) | |

-continued

| | |
|---|---|
| Methylene chloride | 11.7 ml |

*Copolyester of terephthalic acid with ethylene glycol and 2,2-bis-(4-β-hydroxyethoxyphenyl)propane as sold by Goodyear Tire & rubber Co.

The results from these films show that increasing the amount of the agent decreases the relative average contrast.

Table III

| Dye (g) | Agent (g) | Relative Speed (+) Shoulder | Relative Speed (+) Toe | Relative Averge Contrast | Relative Speed (−) Shoulder | Relative Speed (−) Toe | Relative Average Contrast |
|---|---|---|---|---|---|---|---|
| I (0.04) | None | 1300 | 180 | 4.8 | 1150 | 57 | 3.1 |
| I (0.04) | C (0.01) | 140 | 15.7 | 4.0 | 570 | 6.4 | 2.0 |
| I (0.04) | B (0.01) | 1800 | 100 | 3.2 | 855 | 36 | 2.9 |
| I (0.04) | B (0.02) | 785 | 36 | 3.0 | 400 | 14 | 2.8 |
| I (0.04) | B (0.04) | 260 | 8.5 | 2.7 | 157 | 6.4 | 2.9 |
| II (0.02) | None | 230 | 20 | 3.8 | 180 | 11.4 | 3.4 |
| II (0.02) | A (0.01) | 85.5 | 0.7 | 1.9 | 40 | 0.7 | 2.3 |
| III (0.02) | None | 785 | 51 | 3.4 | — | — | — |
| III (0.02) | A (0.01) | 48 | 0.7 | 2.2 | — | — | — |

EXAMPLE IV

Coatings on an aluminum support are made from the following solutions:

| | |
|---|---|
| Vitel PE 101 | 2.0 g. |
| Triphenylamine | 0.5 g. |
| Dye 1 | 50 mg. |
| Tetrabutylammonium salt | |
| Tetrabutyl ammonium iodide (0.033 g. in solution in one ml of methanol) or | 33 mg. |
| Tetrabutyl ammonium bromide (0.029 g) in solution in one ml of methanol) | 29 mg. |
| Methylene chloride | 15 ml. |

Similar coatings in which the triphenylamine is replaced by 0.85 g. of 4,4-benzylidene bis(N,N-diethyl-m-toluidene) are also made. The results given in Table IV show the reduced contrast resulting from the addition of the salt.

Table IV

| Photoconductor | Agent | Effects on Contrast: Relative Speed(+) Shoulder | Relative Speed(+) Toe | Relative Average Contrast |
|---|---|---|---|---|
| Triphenylamine | None | 1600 | 120 | 3.6 |
| Triphenylamine | Compound D | 1400 | 32 | 2.4 |
| Triphenylamine | Compound E | 1200 | 80 | 3.4 |
| 4,4-Benzylidene-bis(N,N-diethyl-m-toluidine) | None | 2000 | 180 | 3.8 |
| 4,4-Benzylidene-bis(N,N-diethyl-m-toluidine) | Compound E | 1200 | 60 | 3.1 |

EXAMPLE V

Coatings on a transparent conducting support are made from solutions containing Vitel PE-101, triphenylamine, and 0.025 m moles of dye per gram of solids as salts of different anions. The data of Table V shows the reduced contrast resulting from the use of iodide or tetraphenylboron salts as compared to that from use of the perchlorate salt, the anion of which is not a hole trap.

Table V

| Dye | Anion | Effects on Contrast: Relative Speed (+) Shoulder | Toe | Relative Average Contrast |
|---|---|---|---|---|
| IV | $C10_4^-$ | 160 | 30 | 5.5 |
| IV | $I^-$ | 160 | 10 | 3.3 |
| V | $C10_4^-$ | 1000 | 100 | 4.0 |
| V | tetraphenylboron | 500 | 4.6 | 2.0 |

EXAMPLE VI

The following solutions are coated at 100 micrometers wet thickness on a transparent conducting support.

| | |
|---|---|
| Vitel PE 101 | 2.0 g. |
| Triphenylamine | 0.5 g. |
| or 4,4'-Benzylidenebis(N,N-diethyl-m-toluidine) | 0.85 g. |
| Dye VI | 40 mg |
| or Dye VII | 25 mg |
| Agent | see Tables VI and VII |
| Methylene chloride | 14 ml. |

The results given in Tables VI and VII show the reduced contrast resulting from the use of the hole-trapping agent.

Table VI

Photoconductor is Triphenylamine

A. Sensitized by Dye VI (40 mg)

| Agent | Amount | Rel. Avg. Contrast(+) | Rel. Avg. Contrast(−) |
|---|---|---|---|
| Control | — | 2.9 | 3.4 |
| E | 10 mg. | 2.2 | 1.9 |
| E | 20 mg. | 2.2 | 2.2 |
| E | 40 mg. | 1.9 | 1.3 |
| G | 40 mg. | 1.0 | 2.8 |
| H | 40 mg. | 2.1 | 1.7 |
| I | 10 mg. | 2.6 | 2.5 |
| I | 20 mg. | 2.2 | 2.4 |
| I | 40 mg. | 2.0 | 2.1 |

B. Sensitized by Dye VII (25 mg.)

| Agent | Amount | Rel. Avg. Contrast(+) | Rel. Avg. Contrast(−) |
|---|---|---|---|
| Control | — | 4.3 | 3.5 |
| J | 20 mg. | 3.4 | 3.2 |
| J | 40 mg. | 3.0 | 3.1 |
| K | 10 mg. | 3.4 | 3.1 |
| K | 20 mg. | 2.8 | 2.3 |
| K | 40 mg. | 2.6 | 2.7 |
| L | 10 mg. | 2.6 | 2.6 |
| L | 20 mg. | 2.6 | 2.7 |
| L | 40 mg. | 2.2 | 2.4 |

Table VII

Photoconductor is 4,4'-Benzvlidenebis(N,N-diethyl-m-toluidine)

A. Sensitized by Dye VI (40 mg.)

| Agent | Amount | Rel. Avg. Contrast(+) | Rel. Avg. Contrast(−) |
|---|---|---|---|
| Control | — | 3.4 | 3.4 |
| L | 20 mg. | 3.0 | 2.9 |
| L | 40 mg. | 2.9 | 3.0 |

B. Sensitized by Dye VII (25 mg.)

| Agent | Amount | Rel. Avg. Contrast(+) | Rel. Avg. Contrast(−) |
|---|---|---|---|
| Control | — | 4.0 | 3.5 |
| F | 10 mg. | 3.4 | 3.0 |
| F | 20 mg. | 3.0 | 3.1 |

EXAMPLE VII

To specifically illustrate the problems which can be obtained by using as a sensitizer for a p-type photoconductive composition a dye salt in which the anion thereof exhibits hole-trapping capability, the following laboratory test was conducted: In this test two similar p-type organic photoconductive compositions were prepared. Each of these compositions contained an identical electrically insulating polymeric binder and an identical p-type organic photoconductor. The sensitizing dye salt selected from use in both of these compositions was a material similar or identical to that described as Compound 31 of Gilman et al. U.S. Pat. No. 3,769,011 noted hereinabove. In the first composition, Sample I, the sensitizing dye salt possessed a chloro-containing anion, i.e., a perchlorate anion; whereas in the second composition, Sample II, the anion of the sensitizing dye salt was an iodide anion which exhibits hole-trapping capability. The amount of the sensitizer incorporated in both Samples I and II was identical and was selected because it represents an optimum amount of this particular sensitizing dye cation for standard p-type organic photoconductive compositions. The specific amounts and components of the photoconductive compositions labelled Sample I and Sample II are set forth hereinbelow:

| | |
|---|---|
| Vitel PE 101 binder | 1.5 g. |
| Triphenylamine photoconductor | 0.5 g. |
| Sensitizer: 2[(3,5-dimethyl-1-phenyl-4-pyrazolyl)vinyl]-1,3,3-trimethyl-3H-pyrrolo-[2,3-b]pyridinium salt* | 0.02 g. |

*Sample I contained a perchlorate anion; Sample II contained an iodide anion and is described as Compound 31 in Table I, Column 4 of Gilman, U.S. Pat. No. 3,767,011.

The following Table shows the substantial adverse effect on sensitization when the dye salt sensitizer contained as the anion thereof an amount of iodide anion hole-trapping agent approximately equivalent to the amount of the sensitizing dye cation of the dye salt. That is, as is apparent from the Table, the Sample II composition exhibits such an excessive decrease in light sensitivity (as compared to the Sample I formulation), that the Sample II composition is of much less utility.

TABLE

| Sample | Sensitizer Anion | Relative Light Sensitivity (i.e., Speed) for Positive Charging (i.e. ⊕) and Negative Charging (i.e. ⊖) as measured at 440 nm. ⊕ Shoulder Speed | ⊕ 100 Volt Toe Speed | ⊖ Shoulder Speed | ⊖ 100 Volt Toe Speed |
|---|---|---|---|---|---|
| I | $C10_4^-$ | 100* | 12.5 | 80 | 5 |
| II | $I^-$ | 9.0 | 0 | 10 | 0 |

*Arbitrarily assigned a speed value of 100 and the other listed speed values were determined relative to this value. A zero relative speed occurs when the measured light sensitivity response was too low to be measured within a reasonable exposure.

The results of this test are to be contrasted with the results presented, for instance, in Examples I and II which show that when a hole-trapping anion, such as a bromide or iodide anion, is incorporated into a p-type organic photoconductive composition together with a sensitizing dye salt having a relatively neutral or inert anion (e.g., a chloro-containing anion such as perchlorate), one obtains a resultant composition which, although exhibiting some loss in light sensitivity, is still quite useful and in addition advantageously exhibits a lowering in its relative average contrast.

The invention has been described in detail with particular reference to certain preferred embodiments thereof, but it will be understood that variations and modifications can be effected within the spirit and scope of the invention.

We claim:

1. A film-forming composition having the characteristic of producing electrophotographic reproductions of reduced contrast, comprising, in solid solution: a p-type organic photoconductor, an n-type spectral sensitizing dye for the photoconductor, the sensitizing dye having an anion comprising a moiety selected from the group consisting of p-toluenesulfonate, fluorophosphate, tetrafluoroborate and chloro groups, and a hole trapping agent derived from a compound other than a spectral sensitizing dye whose oxidation potential in a neutral solution is at least 0.1 volts less than that of said organic photoconductor, said hole trapping agent being present in an amount sufficient to reduce the relative average contrast to at least 10% lower than the relative average contrast in the absence of the hole trapping agent.

2. The composition of claim 1 wherein the hole trapping agent is selected from the group consisting of tetraarylboron anions, bromide ions, and iodide ions.

3. The composition of claim 2 wherein the hole trapping agent is a tetraarylboron anion.

4. The composition of claim 3 wherein the hole trapping agent is a tetraphenylboron anion.

5. The composition of claim 2 wherein the hole trapping agent is a bromide ion.

6. The composition of claim 2 wherein the hole trapping agent is an iodide ion.

7. A film-forming composition having the characteristic of producing electrophotographic reproductions of reduced contrast, comprising, in solid solution: a p-type organic photoconductor, an n-type spectral sensitizing dye for the photoconductor, the sensitizing dye having an anion comprising a moiety selected from the group consisting of p-toluenesulfonate, fluorophosphate, tetrafluoroborate, and chloro groups, and a polyalkylammonium iodide hole trapping agent whose oxidation potential in a neutral solution is at least 0.1 volts less than that of said organic photoconductor, said hole trapping agent being present in an amount sufficient to reduce the relative average contrast at least 10% lower than the relative average contrast in the absence of the hole trapping agent.

8. A photosensitive element capable of producing an electrophotographic reproduction of reduced contrast, comprising an electrically conducting support having coated thereon a photoconductive layer of an electrically insulating, film-forming binder having incorporated therein, in solid solution, a p-type organic photoconductor, an n-type spectral sensitizing dye for the photoconductor, the sensitizing dye having an anion comprising a moiety selected from the group consisting of p-toluenesulfonate, fluorophosphate, tetra-fluoroborate and chloro groups, and a hole trapping agent derived from a compound other than a spectral sensitizing dye whose oxidation potential in a neutral solution is at least 0.1 volts less than that of said organic photoconductor, said hole trapping agent being present in an amount sufficient to reduce the relative average contrast to at least 10% lower than the relative average contrast in the absence of the hole trapping agent.

9. The photosensitive element of claim 8 wherein the p-type organic photoconductor is a p-type amine photoconductor.

10. The photosensitive element of claim 8 wherein the p-type organic photoconductor is phenylidibenzylamine.

11. The photosensitive element of claim 8 wherein the p-type organic photoconductor is triphenylamine.

12. The photosensitive element of claim 8 wherein the p-type organic photoconductor is 4,4-benzylidene-bis-(N,N-diethyl-m-toluidine).

13. The photosensitive element of claim 8 wherein the spectral sensitizing dye is selected from the group consisting of:

6-Chloro-1'-methyl-1,2',3'-triphenylimidazo [4,5-b] quinoxaline-3-indolocarbocyanine-p-toluenesulfonate 2,4,6-Triphenylpyrylium tetrafluoborate 2,6-Bis (4-ethylphenyl)-4-(4-n-amyloxyphenyl) thiapyrylium perchlorate 2-[3,5-Dimethyl-1-phenyl-4-pyrazolyl)vinyl]-1,3,3-trimethyl-3H-pyrrolo[2,3-b]pyridinium salt 2,6-Diphenyl-4-dimethylaminophenylthiapyrylium salt.

14. The photosensitive element of claim 8 wherein the hole trapping agent is selected from the group comprising tetraarylboron anions, bromide ions, and iodide ions.

15. The photosensitive element of claim 14 wherein the hole trapping agent is a tetraarylboron anion.

16. The photosensitive element of claim 15 wherein the hole trapping agent is a tetraphenylboron anion.

17. The photosensitive element of claim 14 wherein the hole trapping agent is a bromide ion.

18. The photosensitive element of claim 14 wherein the hole trapping agent is an iodide ion.

19. The photosensitive element of claim 8 wherein the photoconducting layer has a thickness ranging from 1 micrometer to 500 micrometers.

20. The photosensitive element of claim 8 wherein the photoconducting layer has a thickness ranging from 5 micrometers to 200 micrometers.

21. A photosensitive element capable of producing electrophotographic reproductions of reduced contrast, comprising an electrically conducting support having coated thereon a photoconductive layer of an electrically insulating, film-forming binder having incorporated therein, in solid solution, a p-type organic photoconductor, an n-type spectral sensitizing dye for the photoconductor, the sensitizing dye having an anion comprising a moiety selected from the group consisting of p-toluenesulphonate, fluorophosphate, tetrafluoroborate and chloro groups, and a polyalkylammonium iodide trapping agent whose oxidation potential in a neutral solution is at least 0.1 volts less than that of said organic photoconductor, said hole trapping agent being present in an amount sufficient to reduce the relative average contrast at least 10% lower than the relative average contrast in the absence of the hole trapping agent.

22. In an electrophotographic process comprising the steps of uniformly charging a photosensitive element in the dark, exposing said element to a pattern of activating radiation, and developing the resultant charge pattern with an electroscopic marking material to form an image pattern, the improvement of obtaining an image of reduced contrast which comprises utilizing as said photosensitive element, an element comprising an electrically conducting support having coated thereon a photoconductive layer of an electrically insulating, film-forming binder having incorporated therein, in solid solution, a p-type organic photoconductor, an n-type spectral sensitizing dye for the photoconductor, the sensitizing dye having an anion comprising a moiety selected from the group consisting of p-toluenesulfonate, fluorophosphate, tetrafluoroborate and chloro groups, and a hole trapping agent derived from a compound other than a spectral sensitizing dye whose oxidation potential in a neutral solution is at least 0.1 volts less than that of said organic photoconductor, said hole trapping agent being present in an amount sufficient to reduce the relative average contrast to at least 10% lower than the relative average contrast in the absence of the hole trapping agent.

* * * * *